United States Patent [19]

Milewski

[11] 3,942,080

[45] Mar. 2, 1976

[54] METHOD AND APPARATUS FOR APPLYING A UNIFORM ELECTROSTATIC CHARGE TO ELECTROPHOTOGRAPHIC FILM

[75] Inventor: Stephen Mark Milewski, Holyoke, Mass.

[73] Assignee: Scott Paper Company, Philadelphia, Pa.

[22] Filed: Apr. 5, 1974

[21] Appl. No.: 458,236

[52] U.S. Cl. ..... 317/262 A; 96/1 C; 250/326

[51] Int. Cl.[2] ..... G03G 13/02

[58] Field of Search ..... 317/262 A; 355/3 R, 7; 346/74 ES; 96/1 R, 1 C; 250/324, 326

[56] References Cited

UNITED STATES PATENTS

| | | | |
|---|---|---|---|
| 3,138,458 | 6/1964 | Kimble et al. | 96/1 C |
| 3,775,104 | 11/1973 | Matsumoto et al. | 317/262 A |
| 3,800,154 | 3/1974 | Tanaka | 317/262 A |

*Primary Examiner*—Harold Broome
*Assistant Examiner*—Harry E. Moose, Jr.
*Attorney, Agent, or Firm*—R. Duke Vickrey; William J. Foley

[57] ABSTRACT

Disclosed are apparatus and method for applying a uniform electrostatic charge to an electrophotographic film through use of a corona discharge electrode positioned close to the film, a high voltage AC potential source connected to the electrode and having a potential greater than the corona threshold potential of the electrode, and a high voltage DC potential source connected to the electrode in series with the AC potential source for biasing the AC potential source, the DC potential source voltage being less than the difference between the voltages of the AC potential source and the corona threshold potential of the electrode. The film is subject to a series of first corona discharges of the desired polarity, of which each discharge is alternated with one of a series of second corona discharges having the opposite polarity and of lesser intensity than the first corona discharges.

6 Claims, 4 Drawing Figures

METHOD AND APPARATUS FOR APPLYING A UNIFORM ELECTROSTATIC CHARGE TO ELECTROPHOTOGRAPHIC FILM

RELATED APPLICATIONS

The present invention is described, but not claimed in commonly assigned co-pending application U.S. Ser. No. 349,452 for ELECTROPHOTOGRAPHIC METHOD AND APPARATUS filed Apr. 9, 1973. The disclosure of any portion of the present invention in that application was derived from the present applicant.

BACKGROUND OF THE INVENTION

1. Field of the Invention

The invention relates to a method and apparatus for uniformly electrostatically charging an electrophotographic film.

2. Description of the Prior Art

In electrophotography, it is common to apply a uniform electrostatic charge to the surface of a photoconductive layer. The charge in selected areas is then dissipated in a pattern by exposing the surface to a light image to form an electrostatic latent image. The latent image is then rendered visible by applying thereto finely divided electrostatically charged developer particles which adhere to the surface by electrostatic attraction. Permanent visible images can be obtained, for example, by using thermoplastic developer particles which are heat fused to the photoconductive layer.

Charging is conventionally accomplished by exposing the surface of the photoconductive layer to a corona source, the polarity of which is chosen to produce the desired results upon the particular photoconductive layer being charged. The corona source commonly consists of one or more fine wires postioned close to the photoconductive layer. When a potential on the order of 3,000 volts to 10,000 volts is applied to the wire or wires, a corona is generated and ions are attracted to and deposited on the surface of the photoconductive layer to produce the charge thereon.

Production of negative corona, which is desired for most applications, with a fine wire or wires presents problems not encountered in the production of positive corona. The generation of positive corona appears as a continuous uniform visible sheath surrounding the wire, whereas the negative corona has a tendency to concentrate at discrete points along the wire, appearing and disappearing at different sites.

In electrophotography, superior recordings are obtainable only when very uniform electrostatic charges are established over the entire area of the electrophotographic recording medium before imaging. When there is relative movement between the corona generating elements and the electrophotographic recording medium, any non-uniformity in electrostatic charge which might have been established on the recording medium is substantially reduced, providing such relative motion is parallel to the recording medium and perpendicular to the axis of the corona generating elements. However, when the corona generating elements and the recording medium are substantially stationary, there is a tendency under some operating conditions to provide such non-uniformity of charge as to result in a variable intensity recording. This effect has been somewhat decreased by applying alternating or pulsating potential superimposed on a fixed DC voltage to the corona generating elements. However, even with such excitation there is a tendency to provide recordings having streaks parallel to the corona generating wires.

Electrophotographic recording is becoming popular for storing the ever-increasing volume of documentary material which is presently being generated. It has become particularly desirable to reduce the size of such documents by recording them on microfilm or microfiche. Apparatus for this purpose are conventionally capable of selectively imaging a predetermined portion of the film for each document. One particular apparatus for recording documents on microfiche is described in the previously referred to and commonly assigned U.S. Patent application Ser. No. 349,452, filed Apr. 9, 1973, in the name of Frank C. Gross. In operation of that apparatus, microfiche is positioned to place the predetermined frame on the optical axis of the lens system through which the image is directed and focused onto the fiche. Just prior to directing the image onto the fiche, the photoconductive layer of the fiche is charged by means of a corona discharge produced at an electrode positioned close to the microfiche on the lens axis. Because the film will also be imaged in this same position, it is not convenient to move the film with respect to the electrode during charging, or vice versa.

The apparatus described in U.S. Patent application Ser. No. 349,452 includes a lens module in which is positioned the lens and the corona discharge electrode. Because of confinement of components problems within the apparatus, the lens module size is limited. For example, the opening in the lens module against which the microfiche is placed is limited to the size of the frame to be charged. Also, it is desirable for the corona generating element to be subjected to little confinement to permit more uniform charging of the film. However, the restrictions on lens module size limits the space available for the element. Thus, the ratio of electrode confinement dimensions to corresponding module opening dimensions is limited. Furthermore, because of lens module size limitations, the spacing of the electrode from the film to be charged is limited to a closer spacing than is desired for uniform charging. All of these size limitations make charge uniformity difficult to obtain in this apparatus.

In the past, attempts to produce uniform electrostatic charging included such methods as moving the electrophotographic film with respect to the corona discharge electrode and subjecting the electrophotographic film to a high voltage corona for a sustained period of time. In practicing the latter method, excessive charging could occur, which would break down the photosensitivity of the film. Controls to prevent excessive charging of the film have included the use of shields usually grounded or biased, to attract the major portion of the ionized gases. While many of these attempts may have been suitable for the particular circumstances for which they were designed, they have not been satisfactory for all situations, particularly where no relative movement between the corona discharge electrode and electrophotographic film is possible and where the corona electrode is placed on the optical axis of the imaging system.

Particular disclosures of prior art corona charging are as follows. U.S. Pat. No. 2,879,395 to Walkup discloses a corona charging device in which high voltage AC potential is applied between a plurality of wire, corona discharge electrodes and control electrodes to create a corona discharge. The control electrodes, forming a grill, are positioned between the corona discharge electrodes and the photoelectric surface to be charged and are biased with a DC low voltage source to limit the charge applied to the photoelectric surface. U.S. Pat. No. 2,885,556 to Gundlach discloses a corona charging device which has a pair of wire, corona discharge electrodes, each positioned on opposite sides of the surface to be charged. High voltage AC potential is applied to each electrode to produce coronas of opposite polarity and a low voltage DC potential is connected to a shield in the vicinity of each corona electrode. The low voltage DC potential applied to each shield is of the opposite polarity to that applied to the other shield. The corona charging device disclosed in both the Walkup patent and the Gundlach patent requires relative movement during charging between the corona generating electrodes and the surface to be charged.

U.S. Pat. No. 3,307,034 to Bean discloses a corona charging device which employs a pair of wire, corona discharge electrodes placed on the sides of an imaging optical axis to avoid interfering with the imaging. A high voltage AC potential is applied to both of the corona electrodes with the end of the potential applied to one of the electrodes being opposite to the end applied to the other. High voltage DC biasing potential is applied to both electrodes to control the corona emission by producing corona of only a single polarity. The corona charging device disclosed in the Bean patent also employs shields which are DC biased. U.S. Pat. No. 3,237,068 to Sowiak discloses a corona charging device which employs multiple wire, corona electrodes which are connected to a high voltage DC potential source to produce a corona. The DC potential source is pulsed to reduce non-uniformity of the corona, particularly when negative corona is generated. The Sowiak patent describes the prior art as including AC potential superimposed upon a fixed DC potential to reduce the non-uniformity of negative corona production.

U.S. Pat. No. 3,708,661 to Hansen et al discloses a corona charging device which employs a needle, corona discharge electrode along with counterelectrodes to avoid overcharging the photoelectric surface. A high voltage DC potential is applied to the discharge electrode in the desired polarity to produce the corona. A high voltage DC potential is applied to the counterelectrodes in an opposite polarity to control with improved uniformity the amount of charge imposed on the photoconductive surface. U.S. Pat. No. 3,076,092 to Mott discloses a corona charging device which employs a plurality of wire, corona discharge electrodes connected to a high voltage AC potential source for production of the corona. A DC voltage is superimposed upon the AC voltage to bias the AC voltage so that it produces corona of only one polarity. The Mott apparatus requires relative movement during charging between the surface being charged and the corona generating electrode.

U.S. Pat. No. 3,390,266 to Epping discloses a corona charging device which employs a corona discharge electrode connected to a high voltage AC power source. A grounded metal bar shield is maintained in the vicinity of the corona electrode for production of the corona at the electrode, and a low voltage DC bias is applied between the corona discharge electrode and the surface to be charged to selectively draw charges of the desired polarity. One disclosed embodiment describes a screen grid positioned between the corona discharge electrode and the surface to be charged with the screen grid biased by a DC potential to a potential somewhere between the corona discharge electrode and the surface to be charged. The Epping device requires relative movement between the corona discharge electrode and the surface to be charged.

U.S. Pat. No. 3,332,396 to Gundlach discloses a corona charging device for purposes of development rather than imaging. The corona discharge electrode is connected to a high voltage AC power source which is DC biased to equalize the negative corona output with the positive corona output to create a neutral or zero voltage on the back side of a donor member. U.S. Pat. No. 3,492,476 to Germanos discloses a corona charging apparatus which employs a single wire, corona electrode connected to a high voltage DC power source. A shield in the vicinity of the corona electrode has an AC power source imposed upon it for purposes of improving uniformity of a negative corona generation in the electrode. Relative movement is required between the corona generating electrode and the surface to be charged. Examples of other patents disclosing corona generating devices are U.S. Pat. No. 3,335,273 to Walkup and U.S. Pat. No. 3,714,531 to Takahashi.

It a primary object of the present invention to provide a method and apparatus for uniformly electrostatically charging a photoelectric surface, particularly where that photoelectric surface is provided by a microfiche and the charging apparatus is undesirably limited in size. It is apparent that a number of disadvantages exist in the corona charging apparatus of the prior art. For example, some do not produce uniform charging over the entire surface to be charged. Also, some require complicated arrangements such as biased shields and screens and other electrical arrangements to improve charge uniformity. Additionally, many of them require relative movement between the surface to be charged and the corona discharge electrode, a step which is undesirable when the surface is to be charged and image-exposed in the same position. Furthermore, of those that are suitable for charging the photoelectric surface without relative movement between the surface and charging electrode, most are not capable of imaging immediately after charging while maintaining the charged electrode in a stationary position, because the charged electrode or electrodes interfere with the imaging.

The apparatus and method of the present invention is capable of overcoming all of these disadvantages.

SUMMARY OF THE INVENTION

The corona charging apparatus of the invention consists of a corona discharge electrode which is positioned close to the electrophotographic film to be charged. A high voltage AC potential source is connected to the electrode and has a potential greater than the corona threshold potential of the electrode to produce a corona discharge. A high voltage DC potential source is connected to the electrode in series with the AC potential source for biasing the AC potential source to create a preponderance of corona charge in the desired polarity. The DC potential source is of a lesser voltage than the difference between the AC voltage and the corona threshold potential of the electrode so that while the DC bias creates a preponderance of corona charge in the desired polarity, it also creates some corona charge in the polarity opposite to the desired polarity.

The apparatus of the invention uniformly charges a predetermined portion of an electrophotographic film by subjecting the film alternately to a corona discharge of the desired polarity and a corona discharge of the opposite polarity but of lesser intensity. When the surface of the electrophotographic film is exposed to the first corona discharge of the desired polarity, it is non-uniformly charged in the desired polarity across its surface. When subjected to the alternate corona discharge of the opposite polarity, the predetermined portion of the electrophotographic film is partially discharged. The amount of discharge is proportional to the difference between the charge residing on the surface and the magnitude of the corona charge of the opposite polarity. Therefore, those portions of the electrophotographic film which held the highest charge of the desired polarity are discharged to a greater degree than those portions which held a lesser charge. The result is a general leveling of the residual charge on the electrophotographic film and substantial uniform charge across the entire charged portion of the electrophotographic film. Because the corona discharge of the desired polarity is greater in magnitude or intensity than the corona discharge of the opposite polarity, the net charge on the electrophotographic film is in the desired polarity. Adjusting the ratio of the DC bias voltage to the AC voltage controls the magnitude of the resulting charge on the electrophotographic film.

The apparatus and method of the invention are particularly desirable for use in a system for charging small areas on a larger microfiche or microfilm where the charging apparatus is undesirably limited in size and where imaging of the film is accomplished immediately after charging the film without moving the film to another location. In this use, the corona discharge electrode can be permanently positioned on the imaging optical axis between the imaging lens and the electrophotographic film. The electrophotographic film is grounded to create the corona generating potential between the film and the corona generating electrode.

DESCRIPTION OF THE PREFERRED EMBODIMENTS

While the present invention has beneficial application for corona charging of electrophotographic surfaces in many situations, it will be described herein in its preferred use of charging a predetermined portion of a microfiche which will be imaged in the same location in which it is charged. The microfiche can be one upon which a number of documents are recorded in separate, distinct frames of a small size, such as 11 ¾ × 16 ½ mm.

Figure 2:
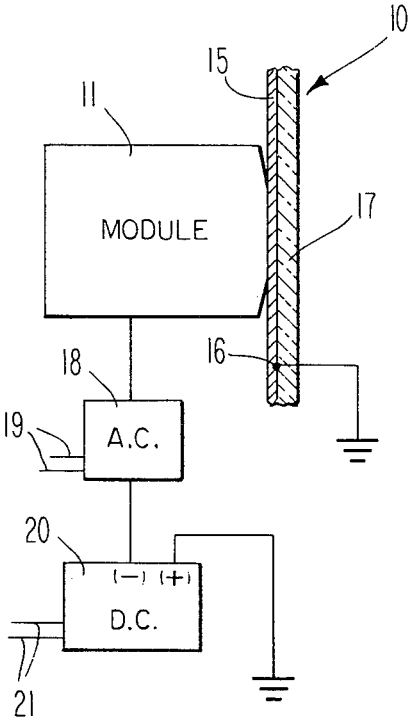
FIG. 2 illustrates schematically the corona generating apparatus of the invention.
Figure 1:
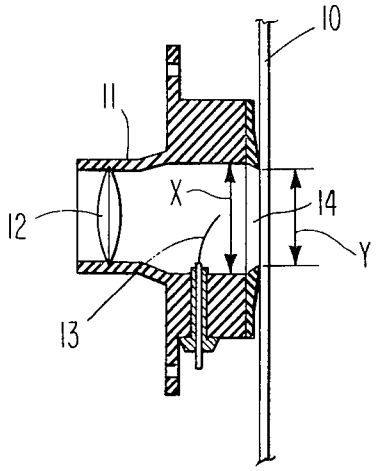
FIG. 1 is a cut-away view of the preferred form of corona generating electrode operably positioned on an imaging optical axis within a lens module of a microfiche duplicating apparatus.

Referring to FIGS. 1 and 2, a conventional electrophotographic film is illustrated as a support 17 coated with a very thin conductive layer 16, which is in turn coated with a photoconductive layer 15. The support 17 is preferably electrically insulating and may comprise any of the well known materials used for such purposes. Any conventional conductive materials may be employed to render conductive layer 16 electrically conductive, such as a plated metallic or other conductive layer coated onto support 17. Similarly, any conventional photoconductive material may be used to form a photoconductive layer 15.

The photoconductive film 10 is preferably grounded through a connection at the conductive layer 16. Grounding may be accomplished by any of a number of well known techniques, such as removing a portion of the photoconductive layer or the insulating support 17 to permit the grounding connection to contact the conductive layer 16. Before imaging, the microfiche is positioned against a lens module 11 to place a frame in the optical axis of the imaging system. Within the lens module 11 are lens 12 and needle, corona discharge electrode 13. Opposite the lens 12 the lens module 11 has a rectangular opening against which the photoconductive layer 15 is placed for charging. The opening is formed by a mask which prevents charging beyond the frame placed against the opening.

The interior of the lens module 11 has a confining effect on the corona generation and transfer to the film 10. For uniform charging of the frame being charged, it would be desired for the dimensions of the interior of the lens module (represented by X) to be much larger than the corresponding dimension of the opening (represented by Y). However, because of size limitations, the interior is restricted to no more than about three times as large as the opening in corresponding dimensions. Furthermore, the corona electrode 13 is restricted to a distance of from about .2 to 2.0 inches from the film, because of similar size limitations.

Just before imaging, the frame to be imaged is charged through production of a corona in the corona electrode 13. The corona is produced from an AC potential source 18, which can be of any conventional form such as a conventional step-up transformer supplied by a conventional low voltage AC power source through leads 19. Connected in series with the AC potential source 18 is a DC potential source 20, which can be of any conventional form, such as a step-up transformer and rectifier circuit supplied by a conventional low voltage AC potential source through leads 21.

FIG. 2 illustrates the DC potential source 20 arranged with the positive polarity grounded and the negative polarity being applied to the corona electrode 13. With this arrangement, a preponderance of negative coronas will be generated, resulting in a negatively charged photoconductive layer 15. If desired, the polarity of the DC potential source 20 could be reversed to positively bias the corona electrode 13, resulting in a positively charged photoconductive surface 15.

Figure 3:
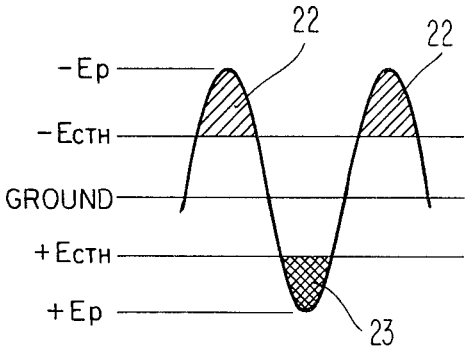
FIG. 3 illustrates the operating wave form of a corona generating apparatus without the DC biasing of the invention.

FIG. 3 illustrates the wave form which would be applied to the corona electrode 13 by the AC potential source 18 without the biasing effect of the DC potential source 20. That wave form is a sinusoidal wave alternating in equal magnitude from the positive and negative sides of ground. Peak voltage applied by the unbiased AC potential source 18 is represented by $-E_p$ for the peak negative voltage and $+E_p$ for the positive potential voltage. The peak voltage is chosen to be greater than the necessary voltage to produce a corona on the particular corona electrode 13 chosen. That necessary voltage is represented by $-E_{cth}$ for a negative corona threshold voltage and $+E_{cth}$ for the positive corona threshold voltage. The corona threshold potential will vary somewhat depending upon the size and shape of the corona electrode 13, but it will typically be between 3,000 volts and 7,000 volts. With some wire configurations, the positive corona threshold potential will be slightly higher than the negative corona threshold potential. For simplicity, FIG. 3 illustrates the positive corona threshold voltage as approximately the same as the negative corona threshold voltage. Thus, the unbiased AC potential source will produce alternating positive and negative corona discharges of approximately equal magnitude. With this arrangement, the resulting charge on the photoconductive layer 15 will be approximately zero.

Figure 4:
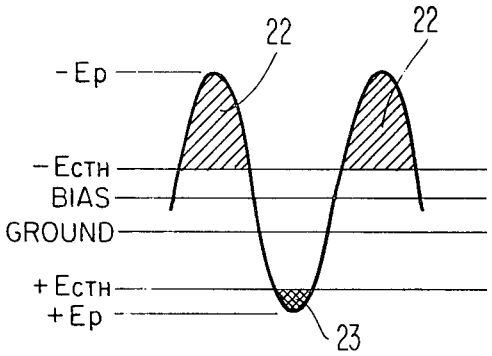
FIG. 4 illustrates the operating wave form of a corona generating apparatus with the DC biasing of the invention.

FIG. 4 illustrates the wave form which would be applied to the corona electrode 13 employing the DC biasing of the invention. That wave form is a sinusoidal wave like that illustrated in FIG. 3, but biased to shift the entire wave in the negative direction. With this DC bias, the negative corona generating voltage (illustrated by the crosshatched area 22) is of greater magnitude than the positive corona generating voltage (illustrated by checkered area 23), resulting in a net negative charge on a photoconductive layer 15. The magnitude of the DC biasing voltage is chosen to significantly increase the magnitude of the negative coronas with respect to the positive coronas, but not so large as to entirely eliminate the positive coronas. Thus, upon receiving an initial negative charge by the first negative corona pulse, the photoconductive layer 15 will be negatively charged overall, but not as uniformly as desired. Immediately following the first negative corona pulse will be a positive corona pulse of lesser magnitude which will partially discharge the negative charge already applied to the plate. The discharging effect will be greater in the more negatively charged areas than in the less negatively charged area, resulting in a leveling of the charge. Upon being subjected to subsequent negative corona pulses, the more negatively charged areas will increase in negative charge to a lesser extent than the less negatively charged areas, as a result of their potential difference from the corona magnitude being less than the more negatively charged areas. The photoconductive layer after being subjected to a series of alternating negative and positive coronas, will be uniformly charged.

Another advantage to the invention is that it substantially reduces the possibility of overcharging portions of the electrophotographic film by constantly discharging the more extensively charged areas to a greater extent than the other areas. Although many variations of the invention are quite useful, a particularly desirable apparatus consists of a needle corona formed by a six mil stainless steel wire located 0.6 inches from the film plane and a power source consisting of a −1.5 kv. DC power supply in series with an 8 kv. AC power supply. The AC power supply is energized from a conventional 110 volt 60 cycle supply and produces a high voltage potential of the same frequency. The corona electrode is positioned within the lens module to permit imaging without moving and to keep the point of the needle electrode centered with respect to the image and preferential charging direction.

As previously described, the voltage of the DC potential source 20 must be such as to reduce the magnitude of the corona generating voltage of the undesired polarity, but not so great as to eliminate it entirely. Thus, the DC potential source voltage must be less than the difference between the voltage of the AC potential source and the corona threshold potential of the electrode. It is particularly desirable for the dimensions of the lens module 11 illustrated in FIG. 1 and described above that the AC power potential source 18 have a voltage of from about 4.0 to about 10.0 KV, and the DC potential source 20 have a voltage of from about 200 to 2,000 volts in either polarity.

While the subject invention is particularly advantageous in producing electrostatic charging on electrophotographic film where there is no relative movement permissable between the film and the electrode, and where the electrode is positioned on the imaging optical axis in the arrangement illustrated in FIG. 1, it should be understood that the invention can be beneficial in many other types of corona charging apparatus.

What is claimed is:

1. Apparatus for applying a uniform electrostatic charge to a predetermined portion of an electrophotographic film, comprising:

means for grounding the electrophotographic film;

a lens module having an opening for charging and imaging the film, the opening being formed by a mask which confines charging of the film to the opening area, each area dimension of the opening being larger than one third of the corresponding dimension within the lens module;

a corona discharge electrode positioned within the lens module at a distance from about .2 to about 2.0 inches from the film when the film is placed against the module opening;

a high voltage AC potential source connected to the electrode and having a potential greater than the corona threshold potential of the electrode; and a high voltage DC potential source connected to the electrode in series with the AC potential source for biasing the AC potential source, the DC potential source being less than the difference between the voltage of the AC potential source and the corona threshold potential of the electrode.

2. Apparatus according to claim 1, wherein the corona producing potential is applied between the corona discharge electrode and the grounded electrophotographic film.

3. Apparatus according to claim 1, wherein the electrode is held stationary with respect to the film during charging.

4. Apparatus according to claim 1, wherein the electrode is provided by needle, the point of which is positioned during charging in a line perpendicular to the center of the predetermined portion.

5. Apparatus according to claim 4, further including a lens for focusing an image on the predetermined portion of the film to reproduce the image on the film, and the electrode is positioned on the optical axis of the lens between the lens and the film.

6. Apparatus for applying a uniform electrostatic charge to a predetermined portion of an electrophotographic film, comprising:

means for grounding the electrophotographic film;

a lens module including a lens for focusing an image on the predetermined portion of the film to reproduce the image on the film, the lens module having an opening for charging and imaging the film, the opening being formed by a mask which confines charging of the film to the opening area, each area dimension of the opening being larger than one third of the corresponding dimension within the lens module;

a corona discharge electrode provided by a needle, the point of which is positioned during charging in a line perpendicular to the center of the predetermined portion and on the optical axis of the lens between the lens and the film at a distance from about .2 to about 2.0 inches from the film when the film is placed against the module opening;

a high voltage AC potential source of from about 4.0 to about 10.0 KV connected to the electrode a high voltage AC potential source of from about 4.0 to about 10.0 KV connected to the electrode; and a high voltage DC potential source of from about 200 to about 2,000 volts connected to the electrode in series with the AC potential source for biasing the AC potential source, the DC potential source being less than the difference between the voltage of the AC potential source and the corona threshold potential of the electrode.

* * * * *